US009295331B2

(12) United States Patent
Slogoff et al.

(10) Patent No.: US 9,295,331 B2
(45) Date of Patent: Mar. 29, 2016

(54) STORAGE DEVICE WITH LOCKING MECHANISM

(75) Inventors: Shelly I. Slogoff, Chester Springs, PA (US); Robert R. King, Elverson, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 332 days.

(21) Appl. No.: 13/991,212

(22) PCT Filed: Dec. 1, 2011
(Under 37 CFR 1.47)

(86) PCT No.: PCT/US2011/062854

§ 371 (c)(1),
(2), (4) Date: Aug. 19, 2013

(87) PCT Pub. No.: WO2012/075264

PCT Pub. Date: Jun. 7, 2012

(65) Prior Publication Data

US 2014/0001930 A1 Jan. 2, 2014

Related U.S. Application Data

(60) Provisional application No. 61/419,511, filed on Dec. 3, 2010.

(51) Int. Cl.

| | |
|---|---|
| ***A47B 95/00*** | (2006.01) |
| ***A47B 88/20*** | (2006.01) |
| ***E05B 47/00*** | (2006.01) |
| ***E05B 47/02*** | (2006.01) |
| ***E05B 65/46*** | (2006.01) |

(52) U.S. Cl.
CPC ..... *A47B 88/20* (2013.01); *E05B 47/0012* (2013.01); *E05B 47/023* (2013.01); *E05B 65/46* (2013.01); *E05B 2047/0024* (2013.01)

(58) Field of Classification Search
CPC ..... E05B 2047/0024; E05B 47/0012; E05B 47/023; E05B 65/46; A47B 88/20
USPC ..... 312/215, 216, 222, 333
See application file for complete search history.

(56) References Cited

U.S. PATENT DOCUMENTS

| | | | |
|---|---|---|---|
| 5,716,116 | A | 2/1998 | Carlson et al. |
| 5,803,559 | A | 9/1998 | Carlson et al. |
| 5,805,075 | A | 9/1998 | Carlson et al. |
| 5,940,306 | A | 8/1999 | Gardner et al. |

(Continued)

OTHER PUBLICATIONS

International Search Report and Written Opinion for PCT/US2011/062854, mailed Mar. 21, 2012; ISA/US.

*Primary Examiner* — Daniel J Troy
*Assistant Examiner* — Timothy M Ayres
(74) *Attorney, Agent, or Firm* — Harness, Dickey & Pierce, P.L.C.

(57) ABSTRACT

A storage device having a locking mechanism includes a housing having a frame assembly. A storage device is movably received in the housing. An actuator is connected to the frame assembly, the actuator operating to move a cam member. A latch is connected to the frame assembly and is moved by contact with the cam member from a latched position preventing access to the storage device in the housing to an unlatched position permitting access to the storage device. An unlock-all mechanism operates to move the latch to the unlatched position without operation of the actuator.

20 Claims, 18 Drawing Sheets

(56) References Cited

U.S. PATENT DOCUMENTS

| | | | | |
|---|---|---|---|---|
| 6,011,999 | A * | 1/2000 | Holmes | 700/231 |
| 6,158,830 | A | 12/2000 | Johnson et al. | |
| 6,511,138 | B1 | 1/2003 | Gardener et al. | |
| 2001/0024039 | A1* | 9/2001 | Lippoldt et al. | 292/197 |
| 2006/0220507 | A1 | 10/2006 | Steele et al. | |
| 2007/0262084 | A1 | 11/2007 | Yuyama et al. | |
| 2008/0278043 | A1 | 11/2008 | Holcomb | |
| 2009/0212670 | A1 | 8/2009 | Bustle et al. | |
| 2010/0114367 | A1 | 5/2010 | Barrett et al. | |
| 2013/0320032 | A1* | 12/2013 | Rahilly | 221/154 |
| 2014/0225491 | A1* | 8/2014 | Shoenfeld | 312/237 |

* cited by examiner

STORAGE DEVICE WITH LOCKING MECHANISM

This application is a National Stage of International Application No. PCT/US2011/062854, filed on Dec. 1, 2011, which claims the benefit of U.S. Provisional Application No. 61/419,511, filed on Dec. 3, 2010. The disclosures of the above priority applications are hereby incorporated by reference in their entirety.

FIELD

The present disclosure relates to a storage device having a locking mechanism for selectively locking or unlocking the storage compartments of the module and a system incorporating same.

BACKGROUND

This section provides background information related to the present disclosure which is not necessarily prior art.

Mobile storage assemblies and mobile computer workstations are well known in the art. Generally, in such mobile workstations, storage space may be provided in the form of shelves or drawers for storage of various work-related items. Additionally, to facilitate a computer and related components, an open, retractable keyboard shelf may be provided to store a computer keyboard when not in use.

U.S. Pat. No. 5,716,116 (Carlson et al.), which is assigned to the assignee of the subject invention and hereby incorporated by reference, discloses a modular storage and support structure that when fully assembled, forms a utility cabinet that can be swingingly secured to each lateral side of the assembly.

U.S. Pat. No. 5,803,559, which is assigned to the assignee of the subject invention and hereby incorporated by reference, discloses a lockable modular storage and support assembly utilizing a locking bar within a corrugated interior surface.

U.S. Pat. No. 5,805,075, which is assigned to the assignee of the subject invention and hereby incorporated by reference, discloses a modular storage and support assembly utilizing vertical support posts. An electronic control system controls a security system for locking and unlocking the modular storage and support assembly.

U.S. Pat. No. 6,158,830, which is assigned to the assignee of the subject invention and hereby incorporated by reference, discloses a lock assembly for use in an enclosed structure housing a locking bar having a plurality of locking fingers. Furthermore, disclosed is a lock arm mechanism having a lock arm and a lock arm mounting assembly for mounting the lock arm mechanism in the enclosed structure. The lock arm causes a rigid finger on the locking bar to be raised and lowered and in doing so raises and lowers the locking bar.

While the above modular storage and support assemblies have proven satisfactory for their purposes, further improvements in such assemblies are desired. What is needed is a modular storage assembly that provides improved locking and un-locking features.

SUMMARY

This section provides a general summary of the disclosure, and is not a comprehensive disclosure of its full scope or all of its features.

According to several embodiments, a storage cabinet includes a housing with individual storage devices that may be moveable between a closed position and an opened position. Locking mechanisms associated with the storage devices may place the storage devices in a locked condition and an unlocked condition. The locking mechanisms include an actuator that drives a cam including a first cam surface and a second cam surface. A latch having a first cam follower surface may be driven by the first cam surface to an unlatched position. A biasing member biasing the latch toward the latched position and/or a sensor module detecting the condition of one of the storage device and latch may also be included.

In some embodiments, the storage devices may have an end wall separating a storage compartment and a locking mechanism engagement portion of the storage device. The locking mechanism engagement portion may include an end face, a retention member and a cavity formed intermediate the end wall and the end face. A first end of the latch may extend into the cavity and the latch may engage the retention member when in the locked condition. The end face of the storage device may have a second cam follower surface driven by the second cam surface to place the storage device in the opened position.

In addition, the storage cabinet may include a control module for managing the operation of the locking mechanism, and an interface module in communication with the actuator and the sensor module.

According to other embodiments, a storage device with a locking mechanism includes a housing having a frame assembly. A storage device is movably received in the housing. An actuator is connected to the frame assembly, the actuator operating to move a cam member. A latch is connected to the frame assembly and is moved by contact with the cam member from a latched position preventing access to the storage device in the housing to an unlatched position permitting access to the storage device. An unlock-all mechanism operating to move the latch to the unlatched position without operation of the actuator.

According to further embodiments, a storage device with a locking mechanism includes a housing having a frame assembly. A plurality of storage devices are individually movably received in the housing. A plurality of actuators are individually connected to the frame assembly. The actuators are individually connected to and operate to move individual cams or a plurality of cam members. A plurality of latches are individually connected to the frame assembly and are individually moved by contact with individual ones of the cam members from a latched position preventing access to any one of the storage devices in the housing, to an unlatched position permitting access to any one of the storage devices. An unlock-all mechanism operates when displaced to move the plurality of latches to the unlatched position without operation of any of the plurality of actuators. A control module communicates with the actuators via command inputs by an operator to activate (for example, energize or de-energize) one, some, or all of the actuators, or the unlock-all mechanism.

According to still other embodiments, a storage device with a locking system of the present disclosure includes multiple bins and/or drawers and provides for the capability to selectively unlock or unlatch any one, some or all of the bins and/or drawers, or collectively unlock all of the bins and drawers simultaneously.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1C:
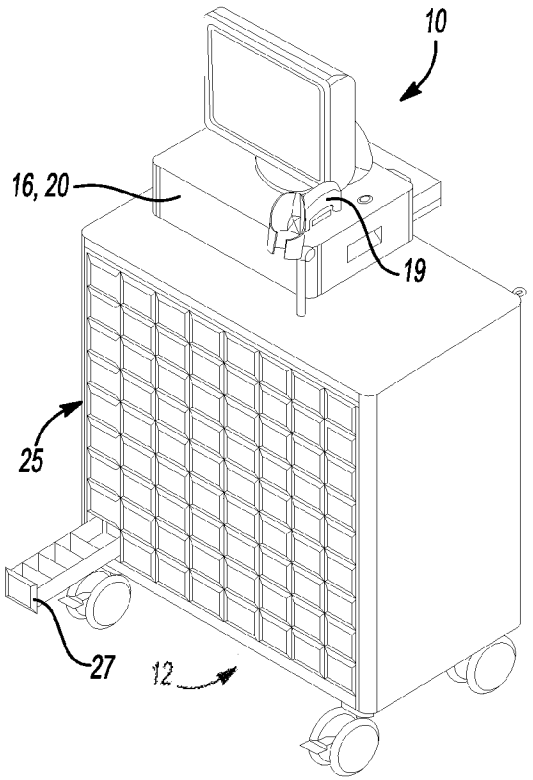
FIGS. 1A-1C are front left elevational perspective views of 3 exemplary mobile workstations each having a storage device with a locking mechanism according to the present disclosure.
Figure 1B:
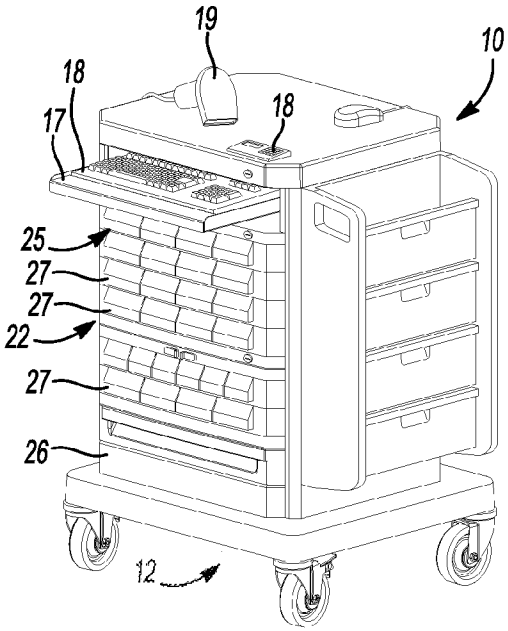
Figure 1A:
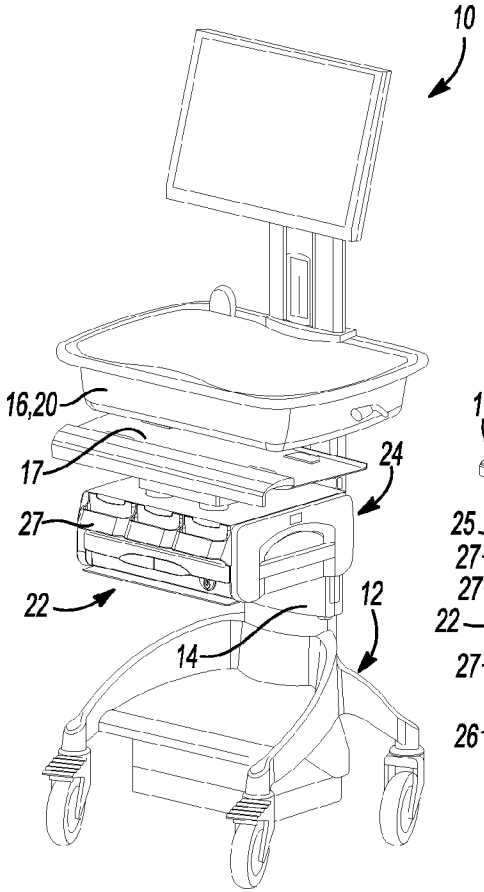

Example embodiments will now be described more fully with reference to the accompanying drawings wherein with reference to FIG. 1A, a mobile work station 10 includes a wheeled chassis 12 permitting transportation of the mobile workstation 10. A vertical support column 14 extends upwardly from the wheeled chassis 12 and provides support for a plurality of items including a control module 16, a user interface module input/output device, such as one or more keyboards 18, which may be located on a keyboard tray 17, on a display, or on a work surface, a UPC or similar data reading device 19, a software module 20 providing software for operation of control module 16, and a storage cabinet 22. According to several embodiments, control module 16 and software module 20 can be incorporated in a general purpose computer, a preprogrammed hardware device, or the like.

According to several embodiments, storage cabinet 22 can include a plurality of storage modules such as first and second storage modules 24, 26. Alternately, as shown in FIGS. 1B and 1C, one or more than two storage modules 24, 25, 26 can be provided. Each storage module can include one or more and/or any combination of individual storage devices 27 such as individual bins, compartments, trays and/or drawers, etc. which are shown in greater detail in FIG. 2 and discussed further herein. The control module 16 using software in software module 20 manages a control operating system to enter data such as individual storage device pass-words or codes, user pass-words or other identification data, and the like, required to lock or unlock individual ones of the first or second storage modules 24, 25, 26 for access by users of mobile work station 10. Depending on the type of material stored in the individual storage modules 24, 25, 26, mobile work station 10 can also provide for locking or unlocking each or all of the individual modules, requiring for example an input code or a manual key in addition to the information received or transmitted by control module 16.

Figure 2:
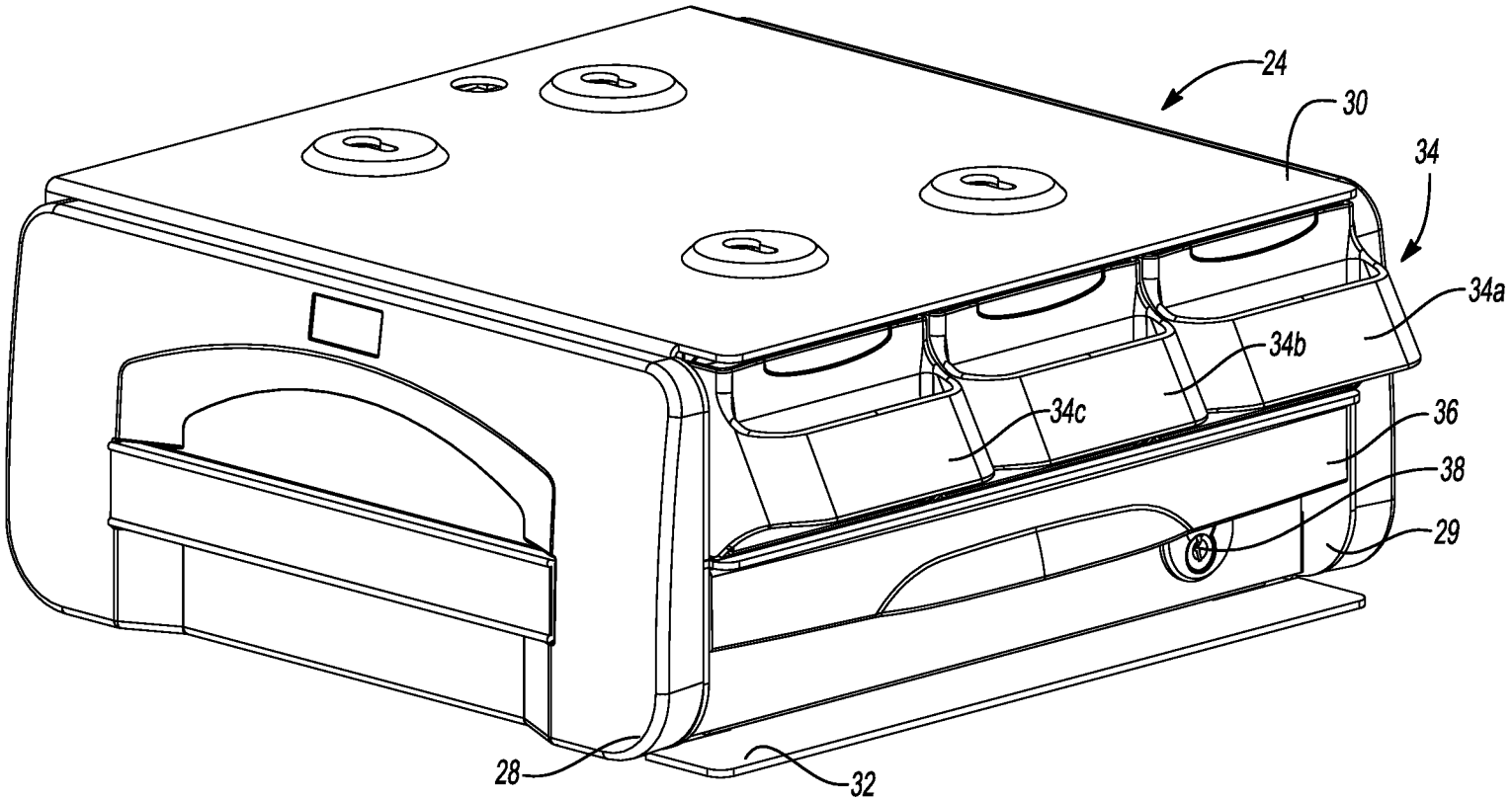
FIG. 2 is a front right perspective view of a storage device with a locking mechanism of FIG. 1A.

Referring to FIG. 2, each storage module, such as exemplary first storage module 24, may include a housing 29 having an upper connection plate 30 and an opposite lower connection plate 32. Upper and lower connection plates 30, 32 can be used to mount or dismount housing 29 with respect to the mobile workstation 10 and/or to one or more other housings. As shown in FIG. 1, each storage module can include a plurality of storage devices 27 including sliding and lockable bins, drawers, trays, compartments, etc. In the example shown in FIG. 2, first storage module 24 provides a plurality of storage devices 27 which can include first, second, and third bins 34*a*, 34*b*, 34*c* which are positioned in a side-to-side configuration. The storage devices 27 can further include one or more sliding drawers 36 located either above or below the bins 34. According to additional embodiments, the individual storage modules can include one or a plurality of storage devices 27, combinations of storage devices such as all bins or all sliding drawers, or additional quantities of either the bins and/or drawers. The storage device design is therefore flexible for multiple configurations as is required, such as for those in FIGS. 1A through 1C.

At a forward facing end of the housing 29, a first manual lock set 38 can be provided such that a key (not shown), tumbler or similar mechanical device can be used to manually lock or unlock a specific one of either the bins 34 or the drawer 36. This can provide for example a redundant or secondary locking system to control access to specific items such as narcotic drugs which require both a first and a second locking system.

Figure 3A:
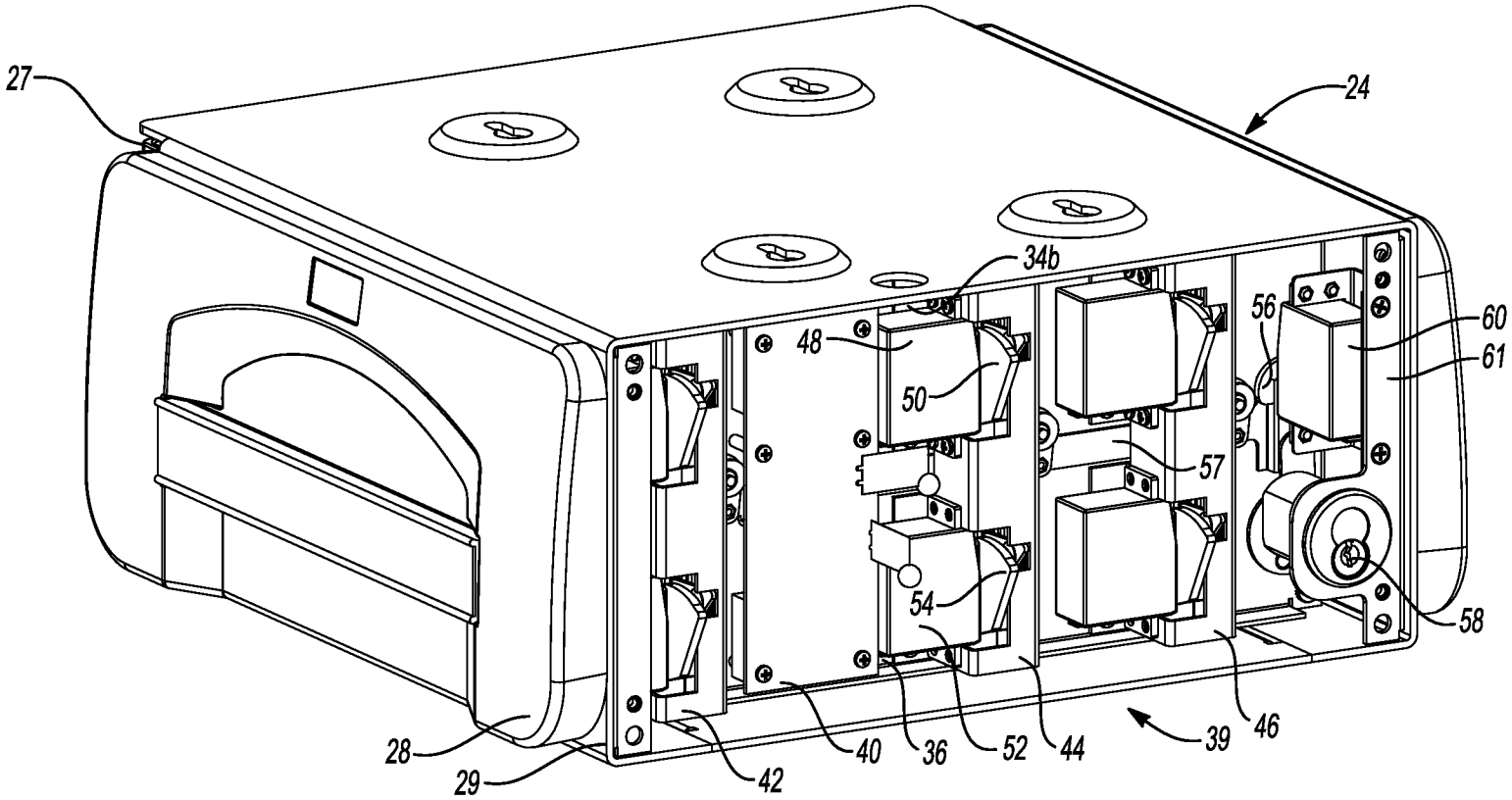
FIG. 3A is a left rear perspective view of the storage device of FIG. 2.

Referring to FIGS. 3A and 3B and again to FIG. 1, a rear portion of first storage module 24 provides a locking mechanism assembly 39 which can be used to lock each of the bins 34 and/or drawer 36, or unlock all or individual ones of the bins 34 and/or drawer 36. Locking mechanism assembly 39, according to several embodiments, can include an interface module 40 which can operate the locking mechanism which will be described in greater detail herein. Interface module 40 is in communication with control module 16. Interface module 40 can be a hard-wired device used to relay commands from control module 16, or can in other embodiments include smart components linked together with control module 16 and software module 20 to control operation of locking mechanism assembly 39. First and second sensors 41*a*, 41*b* can be provided with interface module 40. First and second sensors 41*a*, 41*b* can be, for example, motion detectors or similar sensors providing input to control module 16 to identify when any one or all of the storage devices 27 such as the bins or drawers are moved.

As shown, locking mechanism assembly 39 can include one or more locking mechanisms having one or more frame assembles, for example first, second and third frame assemblies 42, 44, 46. The frame assemblies mount a plurality of actuators which are shown, for example, as servo motors that, individually or in combination, are operable to establish the locked or unlocked conditions of the bins 34 or the drawer 36. In addition to servo motors, the actuators can also be any type of device such as solenoid devices, stepper motors, air or pneumatic devices, magnetic devices, or the like used to establish the locked or unlocked conditions of the storage devices 27. In an exemplary embodiment, a first servo motor 48 is provided for locking or unlocking bin 34*b*. First servo motor 48 is connected such as by fastening to second frame assembly 44 and rotates a first cam member 50. First cam member 50 is directly rotated by operation of first servo motor 48. A second servo motor 52 located beneath first servo motor 48 is operated to directly rotate a second cam member 54 which can be used to lock or unlock drawer 36. Each of the servo motors are in communication with and receive operating signals via interface module 40 from control module 16.

In addition to the individual bin and drawer locking control provided by the servo motors, locking mechanism assembly 39 can further include an unlock-all mechanism 56 with each of the first and second storage modules 24, 26, only a portion of which is shown in FIG. 3. Unlock-all mechanism 56 is linked using a mechanism link 57 to each of the first, second and third frame assemblies 42, 44, 46 such that unlock-all mechanism 56 can override the position of any of the servo motors and cam members to position all of the bins 34 and/or sliding drawers 36 together in their unlocked conditions. Unlock-all mechanism 56 includes a second manual lock set 58 manually operated by a key (not shown) or similar mechanical operator, and an unlock-all servo motor 60, either of which can be used to operate unlock-all mechanism 56 to vertically displace mechanism link 57. Unlock-all servo motor 60 can be operated using control module 16, or if electrical power is not available or as desired by the user, manual lock set 58 can be used as an override or backup. Unlock-all mechanism 56, second manual lock set 58, and unlock-all servo motor 60 are all connected to and supported by a frame assembly 61 which is also connected to housing 29.

Figure 4:
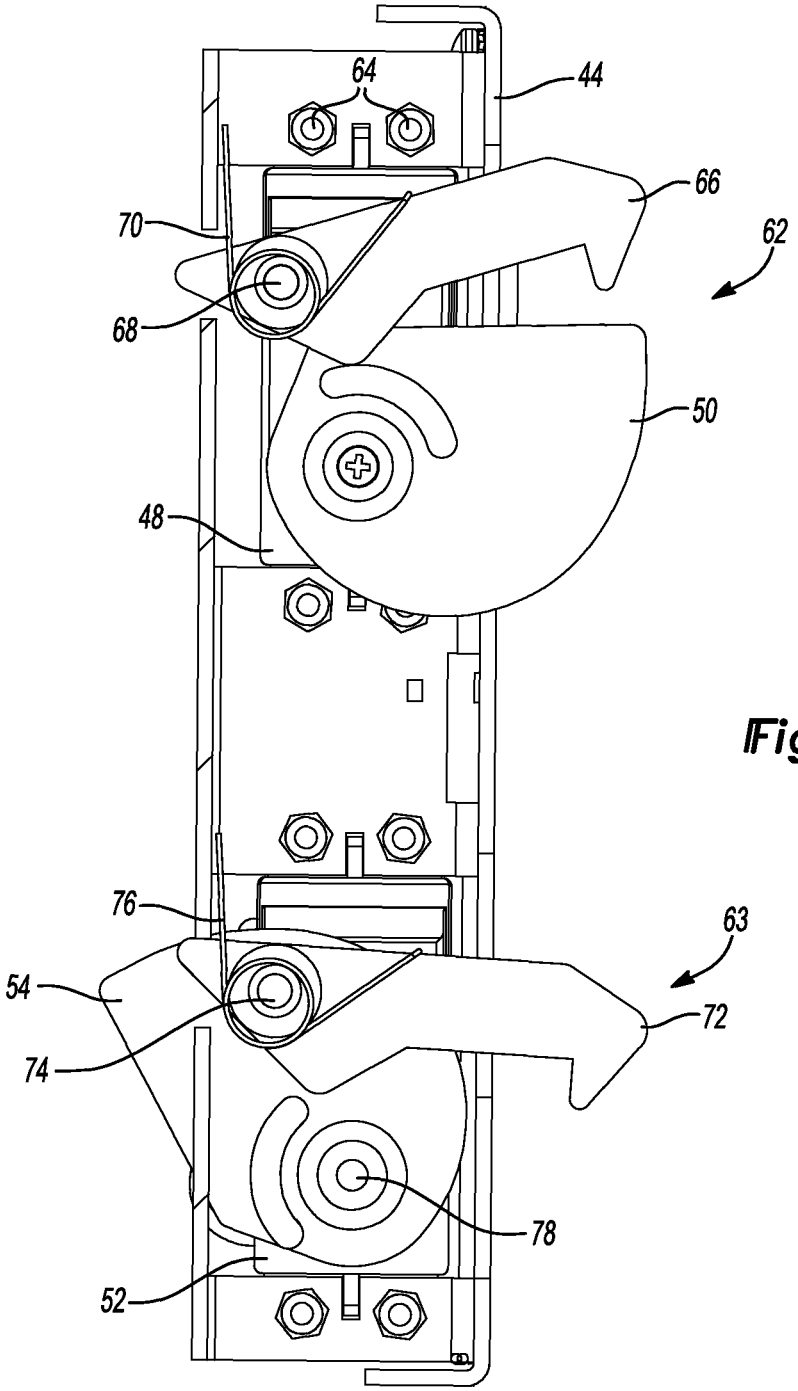
FIG. 4 is a partial cross sectional side elevational view taken at section 4 of FIG. 3.

Referring to FIG. 4, independent first and second servo subsystems 62, 63 each having a servo motor, a cam member, and a latch are shown. Each of first and second servo subsystems 62, 63 are connected in this example to second frame assembly 44, however, according to further embodiments only one of a first or second servo subsystem may be connected to any of the frame assemblies. Fasteners 64 such as threaded fasteners or rivets are used to mount the individual servo motors such as first servo motor 48 to the frame assemblies, such as second frame assembly 44. Individual latches are rotatably displaced by operation of the servo motors which in turn cause rotation of the cam members which directly contact the latches to move the latches from a latched to an unlatched position. In the example shown a bin latch 66 is positioned in the unlatched position and a drawer latch 72 is positioned in a latched position. In this embodiment, bin latch 66 is rotatably connected using a latch pin 68 to second frame assembly 44. A latch biasing member 70 such as a spring is provided for each latch to normally bias the latch to a latched position, which is oriented substantially horizontal as shown for drawer latch 72. Bin latch 66 in the unlatched or upwardly rotated position is achieved by operating first servo motor 48 which directly rotates first cam member 50 to rotate bin latch 66 against the biasing force of latch biasing member 70. Drawer latch 72 is rotatably connected to second frame assembly 44 and is held in the latched position by the biasing force of a latch biasing member 76. Second cam member 54 is shown positioned in an initial cam position which permits latch biasing member 76 to retain drawer latch 72 in the latched position. Each of the cam members are fixed to one of the servo motors using a cam attachment fastener 78.

With continuing reference to both FIGS. 3A, 3B, 4 and 5, each of the frame assemblies includes an unlock-all link such as unlock-all link 80 shown, which is slidingly connected and can be displaced upwardly to rotate all of the latches connected to that frame assembly from the latched to the unlatched position. In the example shown, unlock-all link 80 is slidingly connected to second frame assembly 44 and is shown in a normally downward or disengaged position, which allows the individual servo motors to be operated to control individual ones of the latches.

With continuing reference to FIGS. 1 through 5, each additional bin such as bin 34*a*, 34*c* and/or each additional drawer 36*n* for each of first and second storage modules 24, 26 (or additional storage modules if present) will include a servo motor, cam member and latch to permit individual locking and unlocking of the bin, drawer, tray, compartment, etc. Control commands for the servo motors are similarly fed through interface module 40 from control module 16 such that the user can control the locking and/or unlocking of any individual bin, drawer, tray, compartment, etc. from mobile workstation 10, or control the simultaneous unlocking of all the storage devices of workstation 10.

Figure 5:
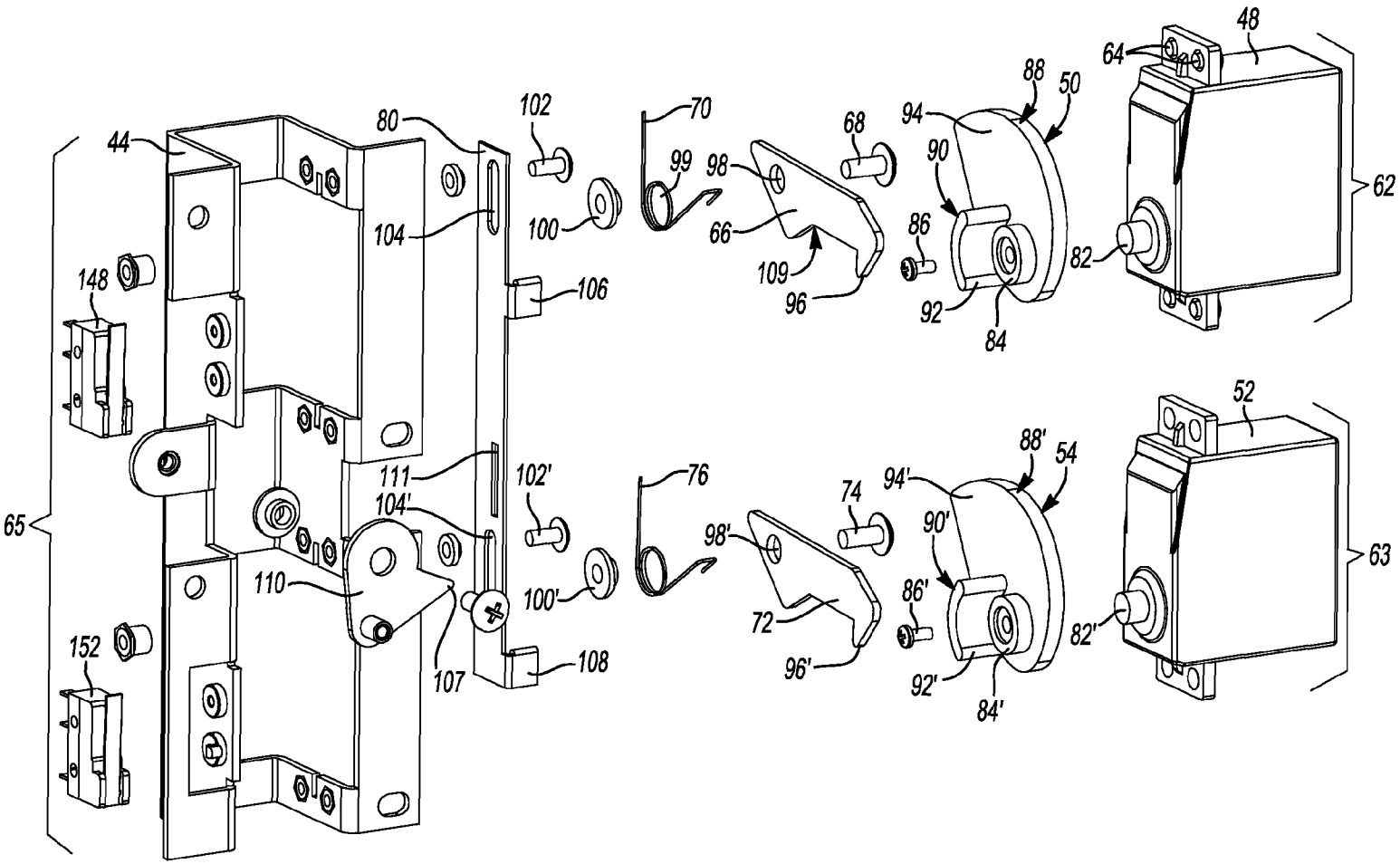
FIG. 5 is an exploded view of multiple sections of a locking mechanism according to the present disclosure.

Referring to FIG. 5, individual components of first and second servo sub-systems 62, 63 and a frame portion 65 of the unlock-all mechanism are depicted. The following discussion of first servo sub-system 62 therefore applies to any servo sub-system. The servo motor 48 includes a drive shaft 82 which is received in a cam bearing member 84 of the individual cam members. A fastener 86 contacting the cam bearing member 84 and received in the drive shaft 82 connects the cam member to the drive shaft 82. Each cam member further includes a curved first cam surface 88 and a curved second cam surface 90. Second cam surface 90 is created on a cam extension 92 which extends perpendicular to a cam body 94. First cam surface 88 is the curved perimeter edge portion of cam body 94.

With continuing reference to both FIGS. 4 and 5, each of the latches includes a latch hook 96 at a first end and a through aperture 98 at a second end. Through aperture 98 receives latch pin 68. The latch pin 68 is also slidably received through a coil portion 99 of latch biasing member 70 to retain the position of the latch biasing member 70 with respect to latch 66. A latch nut 100 retains the latch biasing member 70 and latch 66 in position with respect to the individual frame assemblies.

With continuing reference to FIGS. 3A, 3B, 4 and 5, frame portion 65 includes unlock-all link 80 of frame assembly 44 which is slidably connected to frame assembly 44 using two link retaining fasteners 102, 102' individually received in elongated slots 104, 104' which allow unlock-all link 80 to slide upwardly and downwardly with respect to frame assembly 44. Unlock-all link 80 further includes a first and a second latch displacement arm 106, 108 which are both oriented perpendicular to unlock-all link 80. Each are positioned to contact a bottom latch face 109 of latch 66 and latch 72 such that a vertical upward sliding displacement of unlock-all link 80 causes the first and second latch displacement arms 106, 108 to co-rotate the latches from the latched to the unlatched position. An unlock-all cam 110 is rotatably connected to unlock-all frame assembly 62 and to each of the other frame assemblies. The mechanism link 57 is rotatably connected to each unlock-all cam 110 such that a horizontal displacement of mechanism link 57 rotates the unlock-all cams 110. An extending arm 107 of the unlock-all cams is received in an elongated slot 111 of each of the unlock-all links 80. Rotation of the unlock-all cams 110 causes the extending arm 107 to vertically displace the unlock-all links 80. The unlock-all cams 110 therefore translate a horizontal displacement motion of mechanism link 57 into a vertical displacement motion which vertically displaces each unlock-all link to move the latches to their unlatched positions.

As further seen in FIG. 5, first and second sensor modules 148, 152 can also be connected to any of the frame assemblies, including in the exemplary embodiment shown to second frame assembly 44. Sensor modules can provide signals indicative of the latched/unlatched condition and/or locked/unlocked condition and/or closed/opened condition of the storage devices. According to several embodiments, first and second sensor modules 148, 152 can be switches such as on-off switches shown. For example, first and second sensor modules 148, 152 individually provide a signal indicating either a storage device locked (closed) position direct contact with the bin or drawer, or a storage device unlocked (open) position when the bin or drawer is not in contact with the switch. Other suitable sensor modules can include proximity sensors, Hall effect sensors, vane sensors, photoelectric sensors, snap-action switches and piezoelectric sensors, to name a few.

The following discussion of FIGS. 6 through 15 is related only to first servo sub-system 62, however, it is noted that the description of first servo sub-system 62 applies equally to second servo sub-system 63. Therefore a discussion of second servo sub-system 63 and other servo sub-systems to lock and/or unlock any other storage device of the present disclosure is not provided.

With reference to FIG. 6 and again to FIG. 4, first servo sub-system 62 is shown having bin latch 66 in the latched position and first cam member 50 in the initial cam position. In the initial cam position, a cam maximum extension portion 112 and a second end 113 of bin latch 66 both extend in a rear direction "A" with respect to frame assembly 44. A cam follower 114 of bin latch 66 is directed downwardly, similar to latch hook 96. Also in the initial cam position, the cam follower 114 is freely spaced from the second cam surface 90 of cam extension 92. Second end 113 of bin latch 66 extends rearwardly and partially beyond frame assembly 44, and is in contact with an aperture wall 115 of frame assembly 44 which together with the biasing force of latch biasing member 70 holds bin latch 66 in the latched position shown. Latch biasing member 70 maintains contact pressure with bin latch 66 to hold bin latch 66 in the latched position until cam follower 114 is contacted by the second cam surface 90 during subsequent rotation of first cam member 50.

Figure 6:
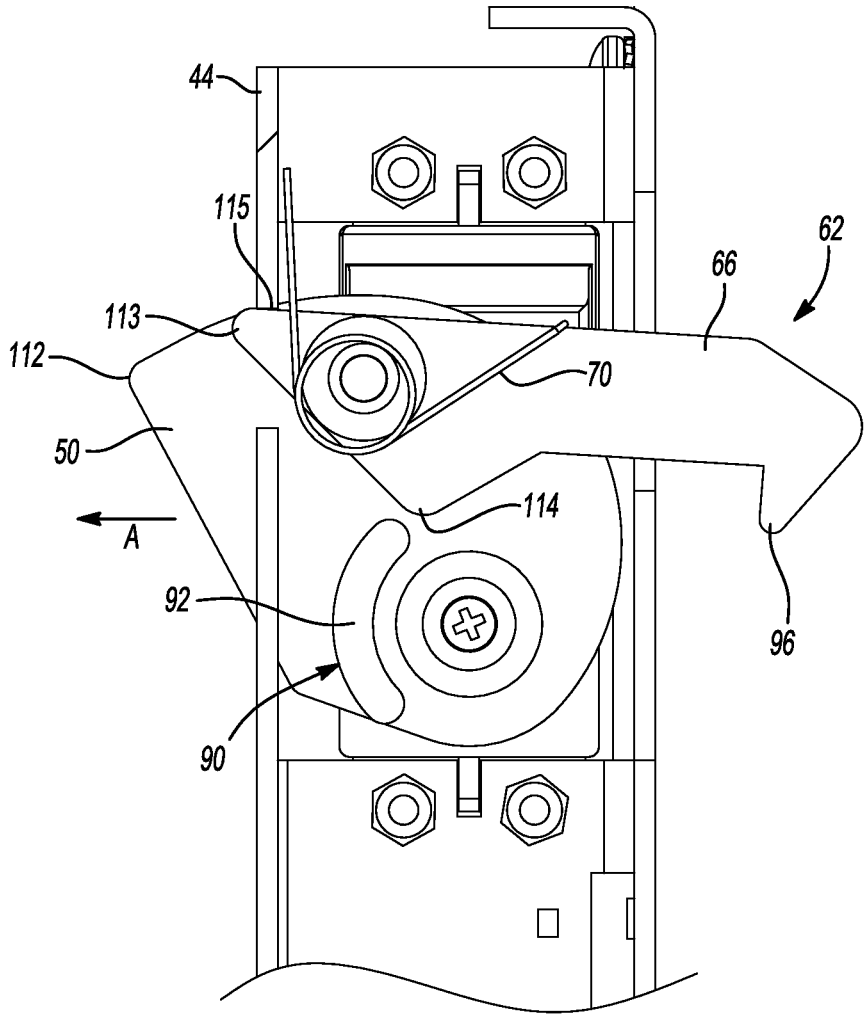
FIG. 6 is a partial cross sectional side elevational view similar to FIG. 4 with the latch shown in a latched position.

Referring to FIG. 7 and again to FIG. 6, bin latch 66 is shown after rotated displacement to its unlatched position. This is achieved by operation of servo motor 48 which directly rotates first cam member 50 in a cam rotation direction "B" which is a clockwise rotation as viewed in FIG. 7. As first cam member 50 rotates with respect to a longitudinal axis defined by cam attachment fastener 78, the second cam surface 90 of cam extension 92 contacts cam follower 114. Because bin latch 66 is rotatably connected by latch pin 68, contact with cam follower 114 causes an oppositely directed rotation of bin latch 66 about a latch open rotation direction "C", which is a counterclockwise rotation as viewed in FIG. 7. Rotation in the latch open rotation direction "C" works against the biasing force of latch biasing member 70 to compress latch biasing member 70. Bin latch 66 will remain in the unlatched position as long as contact between cam follower 114 and second cam surface 90 is maintained. In the exemplary embodiment shown in FIG. 7, second cam surface 90 has approximately 90 degrees of arc, therefore contact between cam follower 114 and second cam surface 90 will be maintained for approximately 90 degrees of rotation of first cam member 50. A different desired rotational arc can be provided by changing the degree of arc for second cam surface 90.

Figure 8:
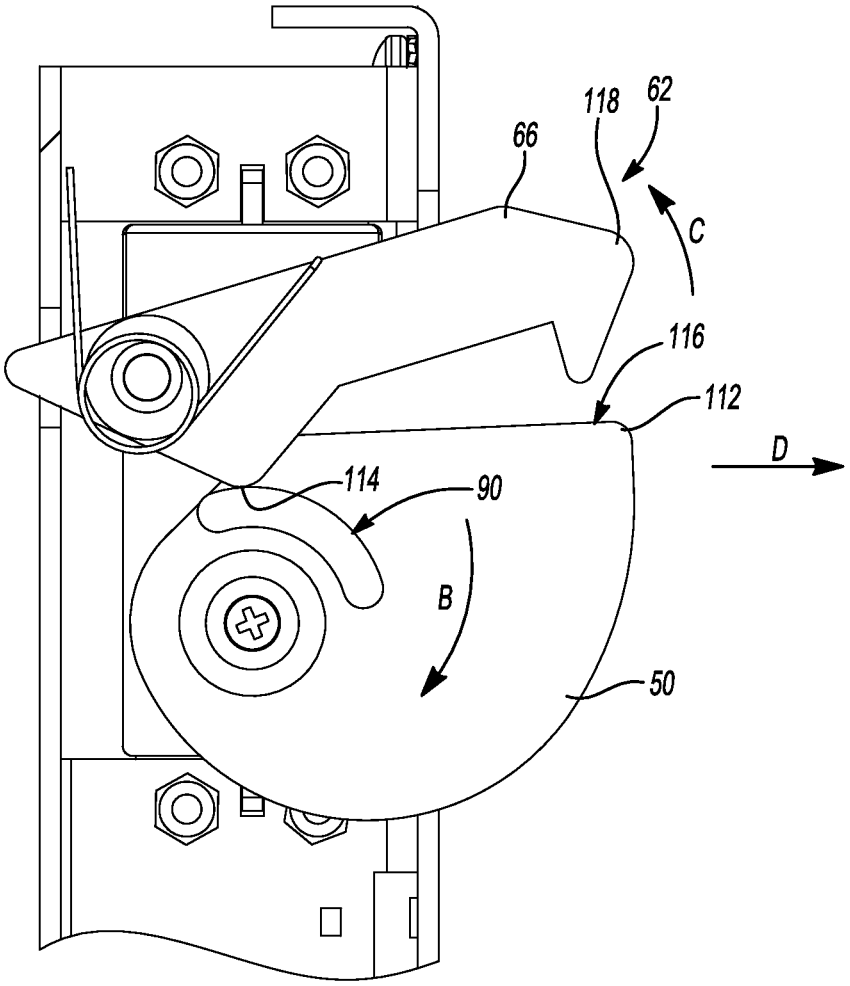
FIG. 8 is a partial cross sectional side elevational view similar to FIG. 6 with the latch shown in an unlatched position and the cam in a cam final contact position.

Referring to FIG. 8, continued rotation of first cam member 50 in the cam rotation direction "B" has resulted in a cam planar face 116 being oriented substantially horizontal and facing upward as shown. In this position, contact is still present between second cam surface 90 and cam follower 114, therefore bin latch 66 is maintained in the unlatched position. Also in this cam rotated position, cam maximum extension portion 112 of first cam member 50 is directed to a maximum extent in a forward direction "D", which positions cam maximum extension portion 112 forward of a latch first end 118.

Figure 9:
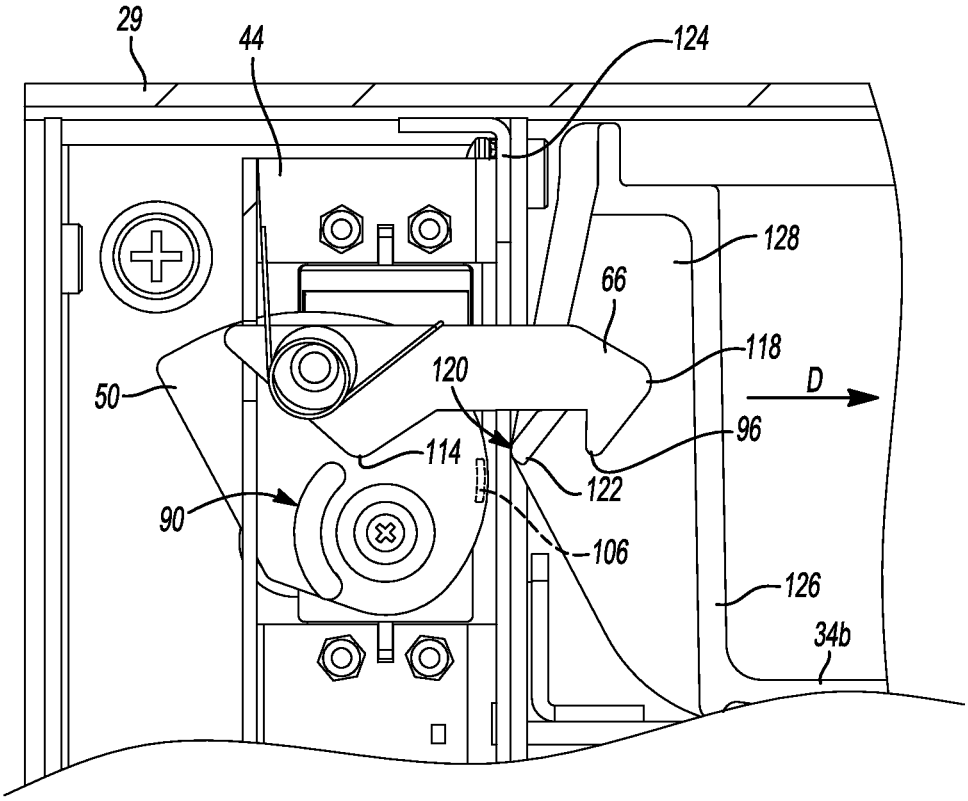
FIG. 9 is a partial cross sectional side elevational view similar to FIG. 4 with the latch shown in a latched position engaging a retention member of a bin.

Referring to FIG. 9, the latched position of bin latch 66 retains bin **34*b* in a locked condition. Bin 34*b* has a bin end face 120. Bin 34*b* further includes a bin retention member 122 positioned proximate bin end face 120. Latch hook 96 of bin latch 66 is positioned forward of bin retention member 122 such that bin 34*b* cannot be displaced in the forward direction "D" for access from outside the housing 29. Also in the bin locked position, bin end face 120 contacts a forward facing plate 124 of second frame assembly 44. Space for receipt of latch hook 96 and latch first end 118 is provided between the bin end face 120 and an end wall 126 of bin 34*b* by provision of a hook clearance cavity 128 of bin 34*b* and drawer 36** respectively.

Figure 7:
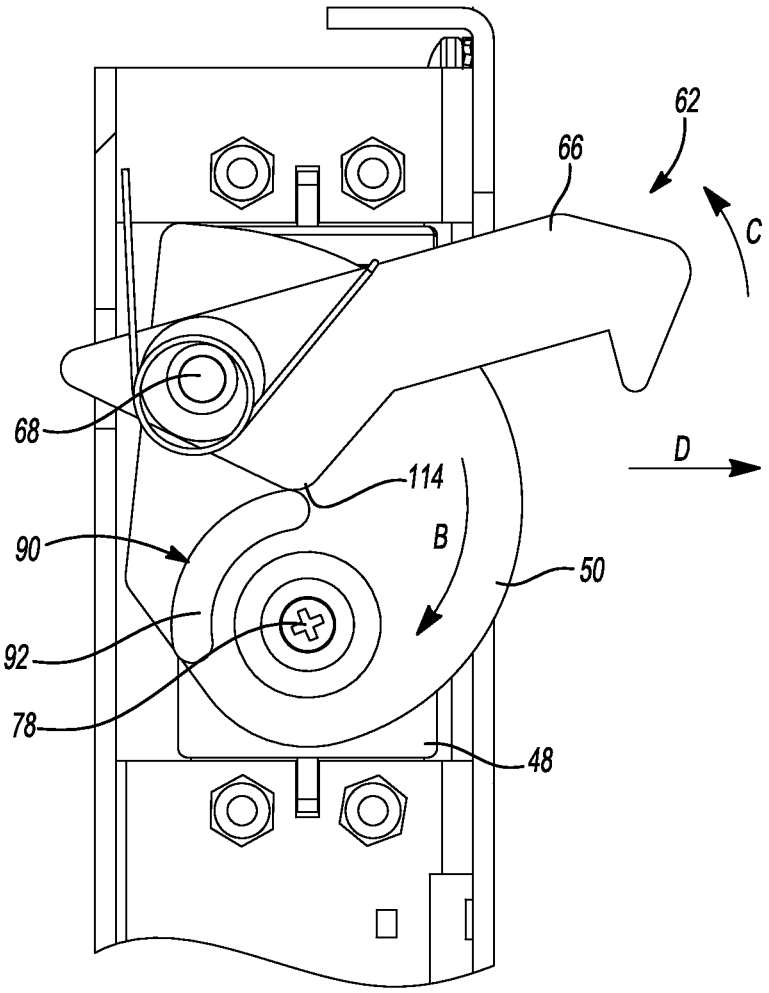
FIG. 7 is a partial cross sectional side elevational view similar to FIG. 6 with the latch shown in an unlatched position and the cam proximate to a cam initial contact position.

With continuing reference to FIG. 9 and FIGS. 5 and 7, the normal positions of first and second latch displacement arms 106, 108 are shown. As previously described, from these normal positions, vertical upward displacement of first and second latch displacement arms 106, 108 will rotate bin latch 66 from the latched position shown to the unlatched position shown in FIG. 7 without rotation of first cam member 50, therefore over-riding servo motor 48.

Figure 10:
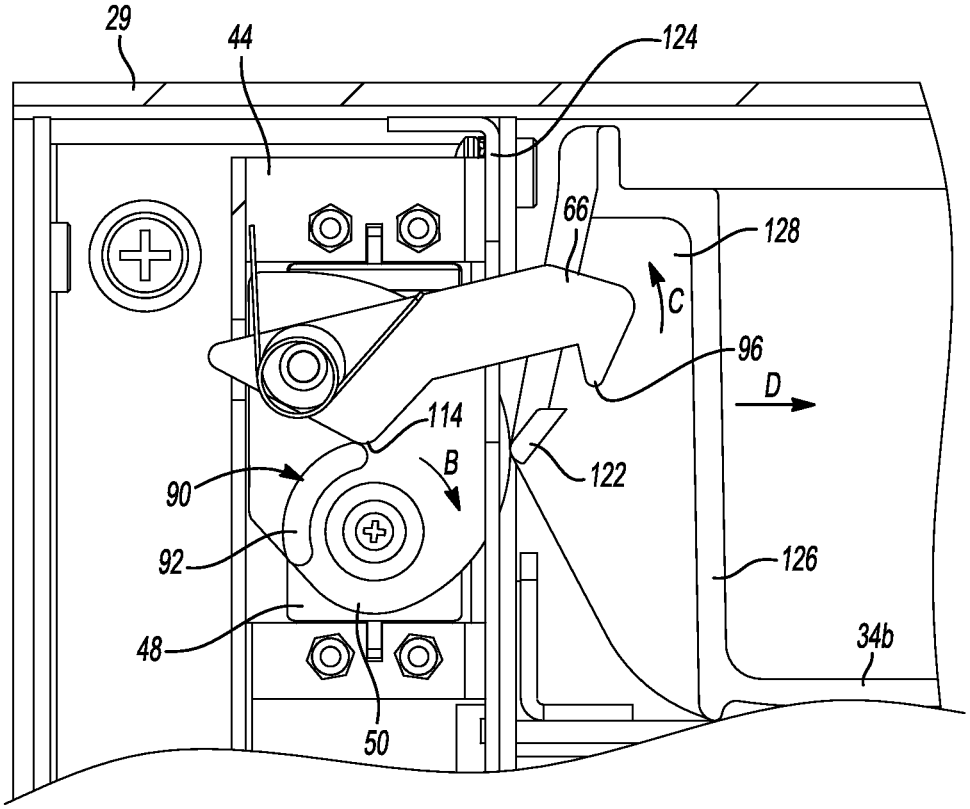
FIG. 10 is a partial cross sectional side elevational view modified from FIG. 9 to show the bin latch in an unlatched position disengaged from the retention member of the bin and the bin cam proximate to a cam initial contact position.

Referring to FIG. 10, first servo motor 48 is operated to begin rotation of first cam member 50. By rotating first cam member 50 in the cam rotation direction "B", second cam surface 90 contacts cam follower 114 and bin latch 66 is rotated in the latch open rotation direction "C" such that latch hook 96 moves upwardly and away from engagement with bin retention member 122. When first cam member 50 is in this transient position bin **34*b*** can be manually pulled in the forward direction "D" to access its contents.

Figure 11:
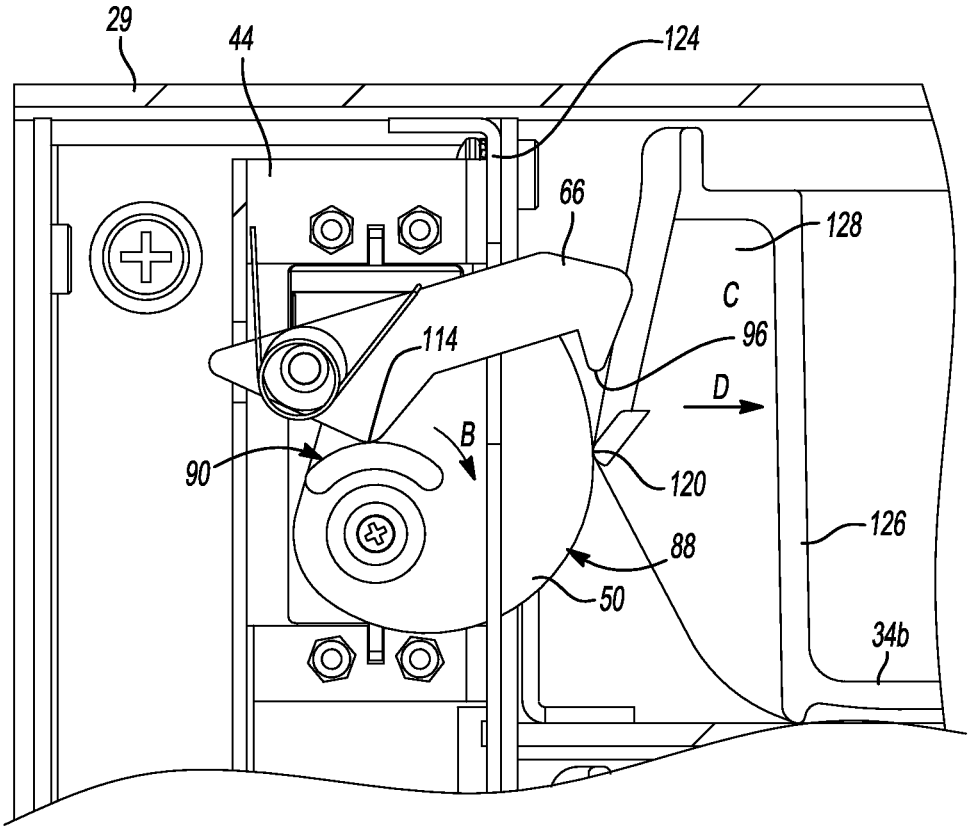
FIG. 11 is a partial cross sectional side elevational view modified from FIG. 10 to show the bin latch in an unlatched position disengaged from the retention member of the bin and the bin cam in a cam mid-contact position.

Referring to FIG. 11, a further feature of the cam members of the present disclosure is evident. By continuing operation of first servo motor 48 to continue rotation of first cam member 50 in the cam rotation direction "B", the first cam surface 88 also extends in the forward direction "D". This forward extension of first cam surface 88 contacts bin end face 120 and begins to automatically push bin 34*b* in the forward direction "D".

Referring to FIG. 12 and again to FIG. 8, the cam maximum extension portion 112 of first cam member 50 when oriented to the maximum extent in forward direction "D" positions the cam maximum extension portion 112 forward of latch first end 118. In this position bin 34*b* is automatically pushed in the forward direction "D" to the bin unlocked condition. Upon reaching this rotated position of first cam member 50, first servo motor 48 then reverses rotation such that first cam member 50 is rotated in a cam reverse rotation direction "BRev", which subsequently releases bin latch 66. Because bin 34*b* has been moved in the forward direction "D" by first cam member 50, the latch hook 96 will not re-engage bin retention member 122 when it rotates downward to the latched position.

Figure 12:
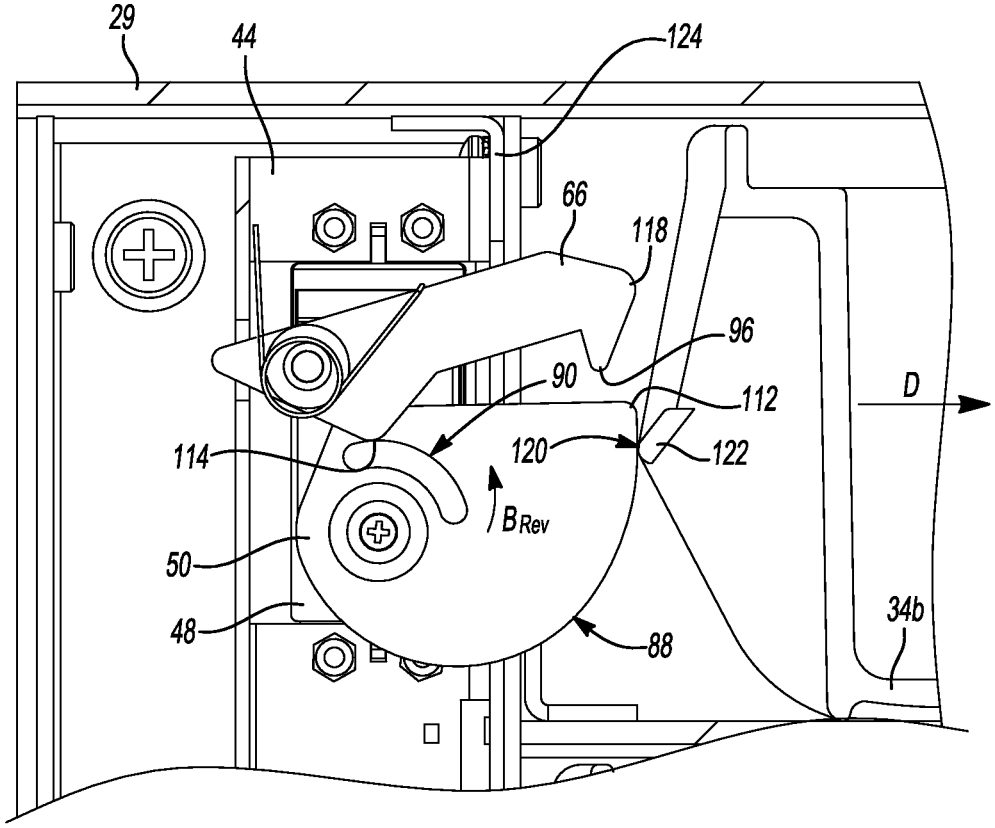
FIG. 12 is a partial cross sectional side elevational view modified from FIG. 11 to show the bin latch in an unlatched position disengaged from the retention member of the bin and the bin cam in a cam final-contact position displacing the bin to a forward release position.

Referring to FIG. 13 and again to FIG. 12, first servo motor 48, either by continuous operation or following a dwell period, has rotated first cam member 50 in cam reverse rotation direction "BRev" substantially back to its initial cam position. In this position bin latch 66 is biased to return to its latched position by rotation in a latch engagement rotation direction "E". Bin 34*b* in the unlocked position cannot be re-engaged by latch hook 96 because latch hook 96 cannot re-enter hook clearance cavity 128 in this condition. Bin 34*b* is therefore free to be manually moved by a user in the forward direction "D" to access its contents.

Figure 13:
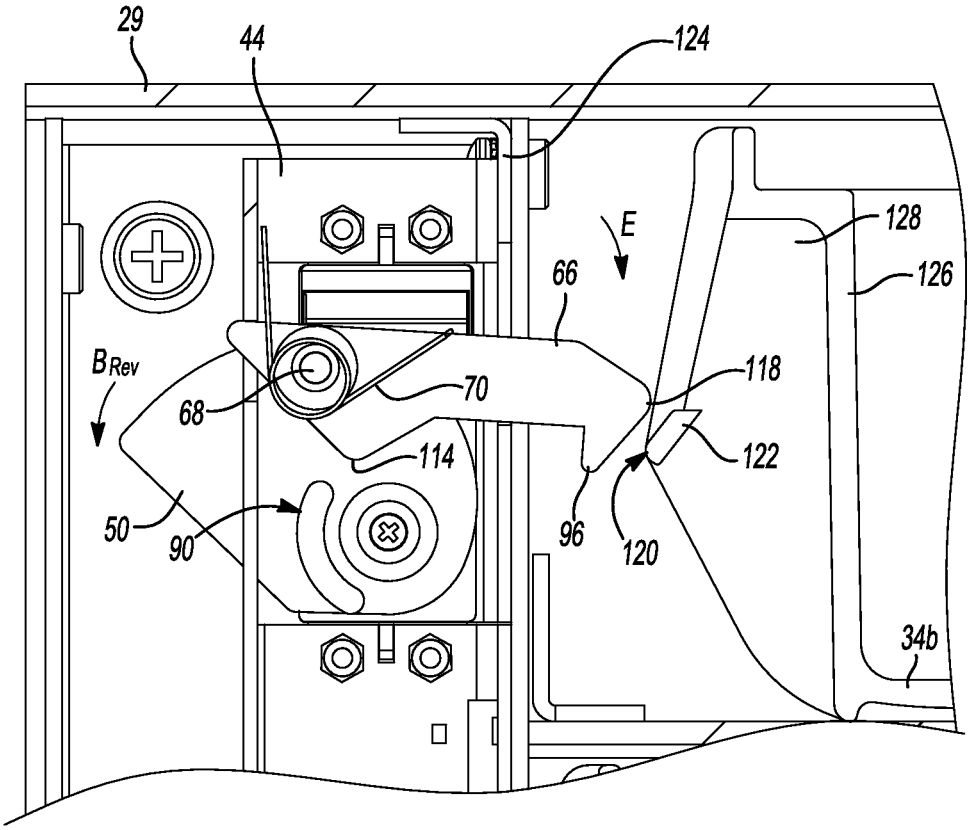
FIG. 13 is a partial cross sectional side elevational view modified from FIG. 12 to show the bin latch in an unlatched position disengaged from the retention member of the bin and the bin cam returned to a cam initial position releasing the latch behind the forward displaced bin.
Figure 14:
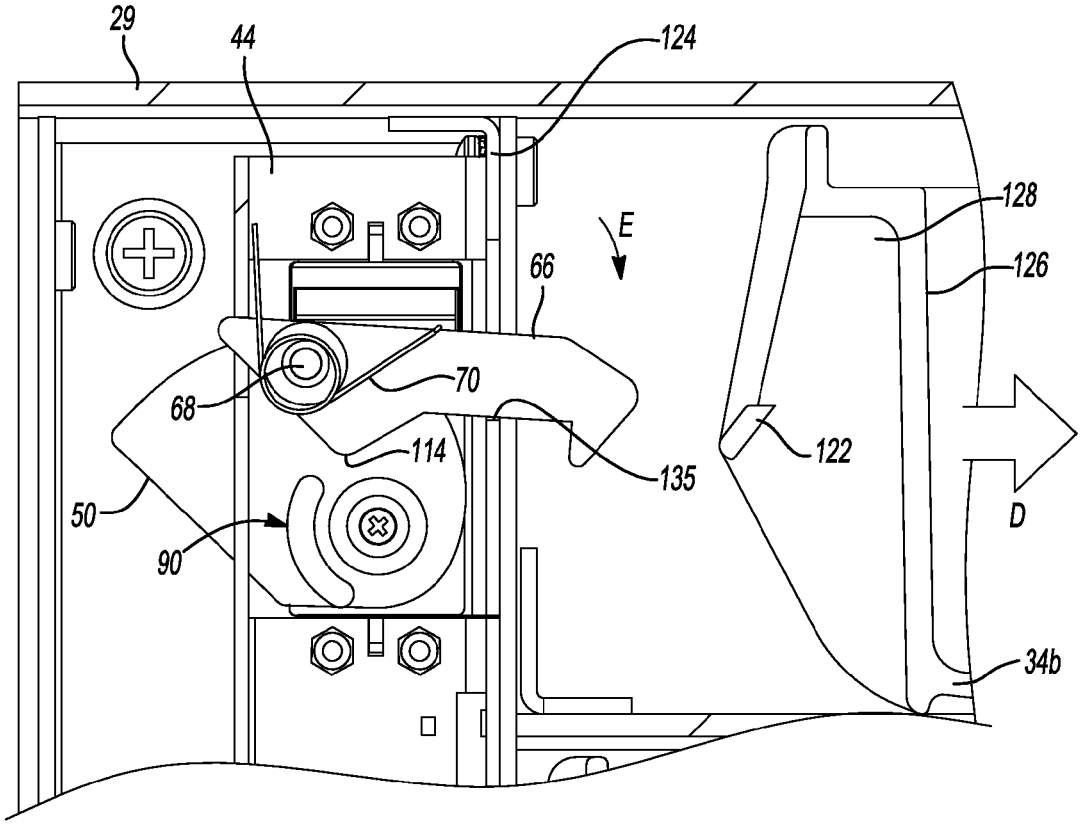
FIG. 14 is a partial cross sectional side elevational view showing a bin in a released position.

Referring to FIG. 14 and again to FIG. 13, bin 34*b* in the unlocked position can be manually withdrawn in the forward direction "D" to access and remove contents of bin 34*b*. The other bins, drawers, trays, compartments, etc. defining the storage devices can be manually withdrawn in the same manner when in the unlocked position. In the unlocked position of bin 34*b*, bin latch 66 is biased by biasing member 70 into contact with an aperture wall 135 of forward facing plate 128 of second frame assembly 44 to stop further rotation of bin latch 66 in the latch engagement rotation direction "E".

Figure 15:
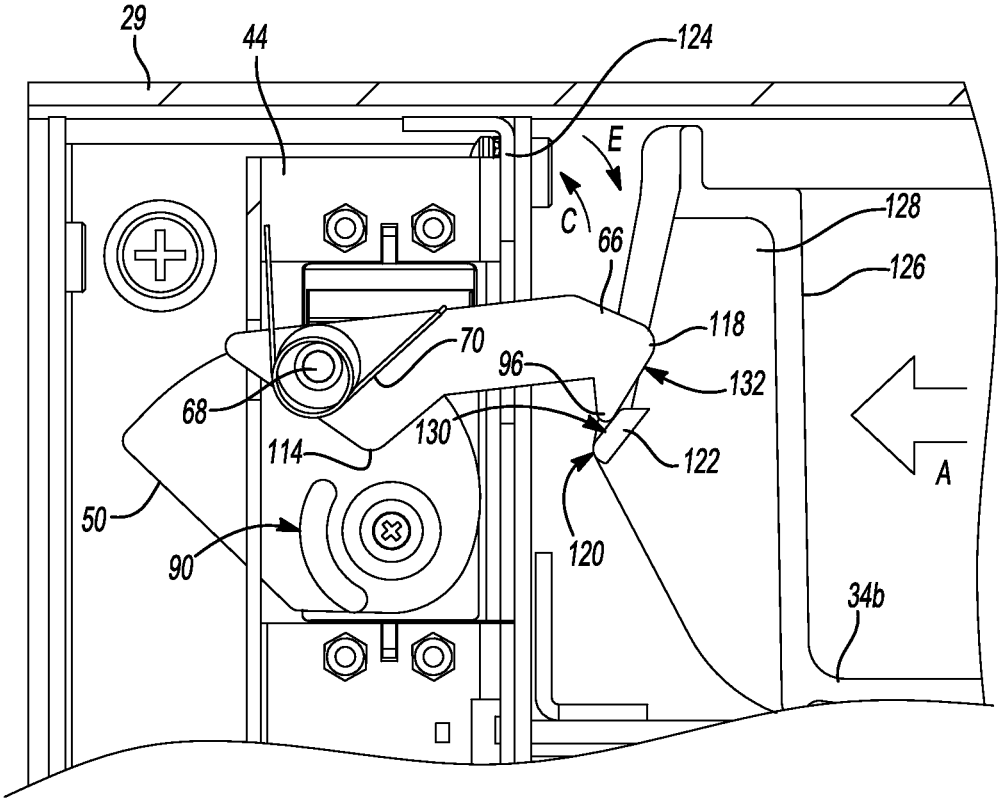
FIG. 15 is a partial cross sectional side elevational view modified from FIG. 13 to show re-latching of the bin.

Referring to FIG. 15, to re-engage bin 34*b* in the locked position, the user can manually push bin 34*b* in the rear direction "A" until a tapered face 130 of bin retention member 122 contacts a tapered face 132 of latch first end 118. This camming action causes bin latch 66 to rotate in the latch open rotation direction "C" until latch hook 96 and latch first end 118 extend past bin retention member 122 and enter hook clearance cavity 128. Bin latch 66 will thereafter rotate in the latch engagement rotation direction "E" due to the biasing force of latch biasing member 70 such that latch hook 96 once again engages bin retention member 122.

Figure 3B:
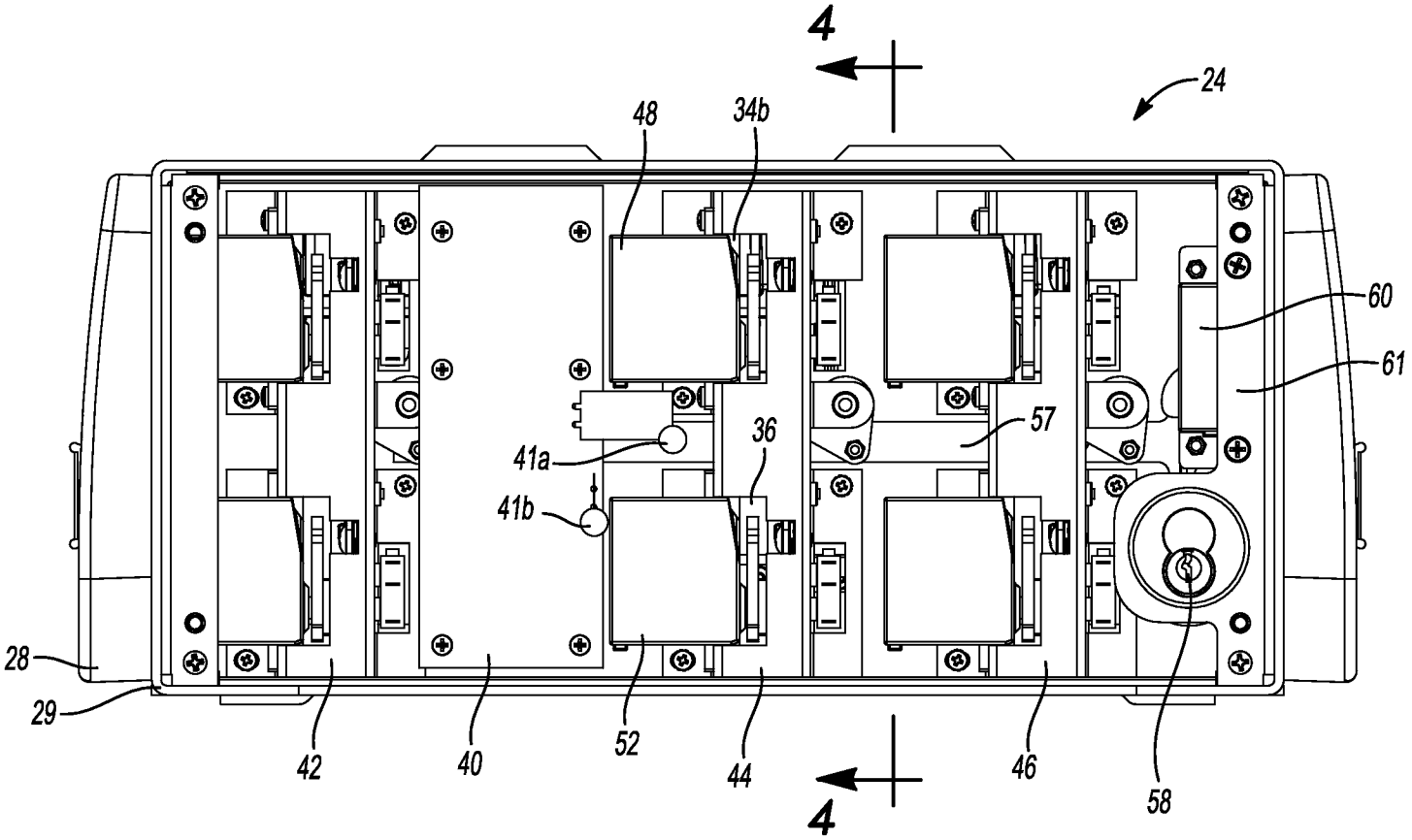
FIG. 3B is a rear elevational view of the storage device of FIG. 2.
Figure 16:
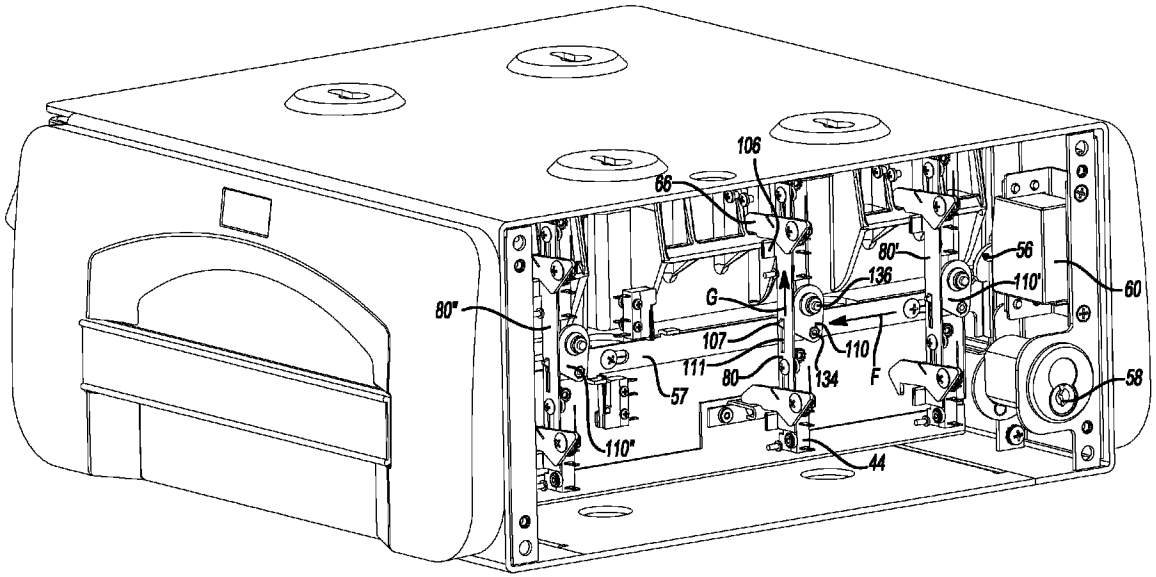
FIG. 16 is a left rear perspective view of the storage module of FIG. 2 having components removed to more clearly depict the unlock-all mechanism and associated components.

Referring to FIG. 16 and again to FIGS. 3B and 5, operation of the unlock-all mechanism 56 is as follows. Operation of either unlock-all servo motor 60 or second manual lock set 58 horizontally translates mechanism link 57 in a displacement direction "F". Each of the unlock-all cams 110, 110', 110" are rotatably connected to the mechanism link 57 using first rotational fasteners 134 and are rotatably connected to structure of the frame assemblies such as second frame assembly 44 using a second rotational fastener 136 which is positioned off-center with respect to first rotational fasteners 134. Horizontal displacement of the mechanism link 57 therefore rotates the unlock-all cams 110, 110', 110", for example in a clockwise rotation as viewed in FIG. 16. As the unlock-all cams rotate the extending arm 107 contacts an end wall of elongated slot 111 causing the unlock-all links 80, 80', 80" to displace vertically upward, in a vertical displacement direction "G". This displacement causes the first and a second latch displacement arms 106, 108 of unlock-all links 80, 80', 80" to rotate all of the latches such as bin latch 66 toward their unlatched positions.

Figure 17:
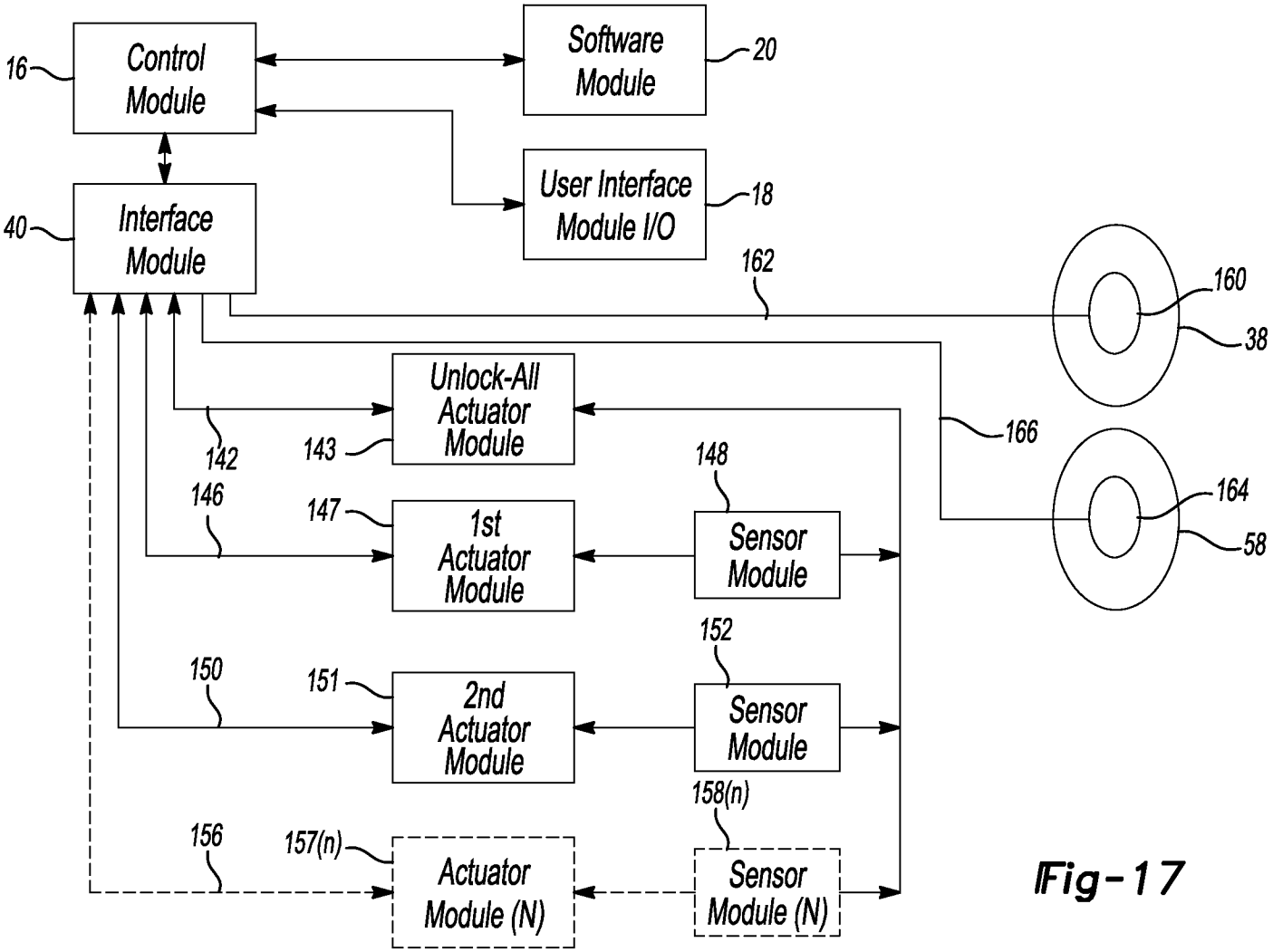
FIG. 17 is a diagrammatic view of a control and operating system for the storage device locking mechanisms of the present disclosure.

Referring to FIG. 17, and again to FIG. 1, the schematic representation of a control and operating system for the storage device and locking mechanisms of the present disclosure shows a control module 16 is in communication with software module 20. Commands and feedback signals to/from unlock-all actuator module 143 are provided via a control line 142 between unlock-all actuator module 143 and an interface module 40. Commands and feedback signals between interface module 40 and a first actuator module 147 are provided via a control line 146. A sensor module 148, such as a bin position sensing device, can provide signals indicative of the latched/unlatched condition and/or locked/unlocked condition of the storage devices. Signals from the sensor module 148 can be carried via control line 146. Commands and feedback signals between interface module 40 and a second actuator module 151 are provided via a control line 150. A second sensor module 152, such as a drawer position sensing device, can be provided together with second servo motor 52 whose signals can be carried via control line 150. Similarly, commands and feedback signals between interface module 40 and any additional actuator modules 157(*n*) are provided via additional control line(s) 156(*n*). Correspondingly, additional sensor modules 158(*n*) can be provided for each additional actuator module whose signal can also be carried via additional control line(s) 156(*n*). The several sensor modules 148, 152, 158(*n*) can also provide signals to unlock-all actuator module 143 via control line 144, or alternatively, such signals can be provided to unlock-all actuator module 143 via the interface module 40.

A first lock position sensor 160 can be provided with first manual lock set 38 to provide feedback to control module 16 via interface module 40 of the lock/unlock position of first manual lock set 38. The signal from first lock position sensor 160 is carried via a data transfer line 162. Similarly, a second lock position sensor 164 can be provided with second manual lock set 58 to provide feedback to control module 16 via interface module 40 of the lock/unlock position of second manual lock set 58. The signal for second lock position sensor 164 is carried via a data transfer line 166.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

As described, the term module can include an application specific integrated circuit (ASIC), an electronic circuit, a processor (shared, dedicated, or group) and memory that execute one or more software or firmware programs, a combinational logic circuit, and/or other suitable components that provide the described functionality.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A storage cabinet comprising:

a housing;

a plurality of storage devices included in the housing, each storage device being moveable between a closed position and an opened position;

a locking mechanism associated with each storage device, each locking mechanism operable to place the associated storage device in one of a locked condition and an unlocked condition, each locking mechanism comprising:

an actuator;

a first cam operably driven by the actuator, the first cam including a first cam surface and a second cam surface;

a latch comprising a first cam follower surface operably driven by the first cam surface to an unlatched position; and a biasing member biasing the latch toward a latched position;

a sensor module detecting the condition of one of the storage device and latch;

each storage device comprising an end wall separating a storage compartment of the storage device and a locking mechanism engagement portion of the storage device, the locking mechanism engagement portion comprising:

an end face;

a retention member; and a cavity formed intermediate the end wall and the end face;

wherein a first end of the latch extends into the cavity and the latch engages the retention member when in the locked condition; and the end face of the storage device comprising a second cam follower surface operably driven by the second cam surface to place the storage device in the opened position.

2. The storage cabinet of claim 1, wherein the locking mechanism further comprises an interface module, the interface module being in communication with the actuator and the sensor module.

3. The storage cabinet of claim 1, further comprising a control module in communication with the interface module, the control module managing the operation of the locking mechanism.

4. The storage cabinet of claim 1, wherein the locking mechanism further comprises at least one frame mounting at least one locking mechanism to the housing.

5. The storage cabinet of claim 1, wherein the retention member comprises a second cam and the first end of the latch comprises a third cam follower surface operably driven by the second cam to move the latch in a direction toward the unlatched position when returning the storage device to a closed position.

6. The storage cabinet of claim 1, wherein at least one of the locking mechanisms further comprises a manual override lock set.

7. The storage cabinet of claim 1, further comprising a plurality of frames mounting the plurality of locking mechanisms to the housing.

8. The storage cabinet of claim 7, further comprising an unlocking mechanism associated with all of the storage devices and operable to simultaneously place all of the plurality of storage devices in an unlocked condition.

9. The storage cabinet of claim 8, wherein the unlocking mechanism comprises:

an actuator;

a first link operably connected to the actuator;

a plurality of unlocking cams pivotably attached to the first link and pivotally attached to the plurality of frames; and a plurality of second links attached to the plurality of frames, each second link operably connected to a corresponding one of the plurality of unlocking cams, the second links comprising at least one extension portion engaging a corresponding latch of the locking mechanisms.

10. The storage cabinet of claim 8, wherein the unlocking mechanism further comprises a manually operated lock set.

11. The storage cabinet of claim 1, wherein the sensor module detects whether the latch is in one of the latched and unlatched positions.

12. A storage device having a locking mechanism, comprising:

a housing;

a plurality of storage devices received in the housing, each storage device moveable between a closed position and an opened position;

a plurality of locking mechanisms, each locking mechanism associated with one storage device of the plurality of storage devices and comprising:

a frame attached to the housing;

a first actuator connected to the frame and operable to move a first cam member;

a latch connected to the frame and moveable by contact with a respective first cam member from a latched position preventing access to the storage device in the housing to an unlatched position permitting access to the storage device in the housing; and an unlock-all mechanism associated with all of the plurality of storage devices and operable to move each of the latches to the unlatched position without operation of any of the first actuators, the unlock-all mechanism comprising:

a first link;

a plurality of unlocking cams pivotably attached to the first link and pivotally attached to the frame; and a plurality of second links attached to the frame, each second link operably connected to a corresponding one of the plurality of unlocking cams, the second links comprising at least one extension portion engaging a corresponding latch of the locking mechanisms, wherein the extension portion is spaced apart from a first rotational member about which the unlocking cam is pivotably attached to the frame and spaced apart from a second rotational member about which the unlocking cam is pivotably attached to the first link.

13. The storage device of claim 12, further comprising a control module in communication with the actuator, the control module operating responsive to commands input by an operator to operate the actuator or to operate the unlock-all mechanism.

14. The storage device of claim 12 wherein the storage devices each comprise an end wall separating a storage compartment of the storage device and a locking mechanism engagement portion of the storage device, the locking mechanism engagement portion of the storage device comprising:

a end face;

a retention member; and a cavity formed intermediate the end wall and the end face; and wherein a first end of the latch extends into the cavity and the latch engages the retention member when in the latched position.

15. The storage device of claim 14 wherein:

the first cam member comprises a first cam surface and a second cam surface;

the latch comprises a first cam follower surface operably driven by the first cam surface to the unlatched position; and the end face of the storage device comprises a second cam follower surface operably driven by the second cam surface to place the storage device in an opened position.

16. The storage device of claim 12 wherein:

the first cam member comprises a first cam surface;

the latch comprises a first cam follower surface operably driven by the first cam surface to the unlatched position; and the locking mechanism further comprises a biasing member biasing the latch toward the latched position.

17. The storage device of claim 16 wherein:

the first cam member comprises a second cam surface; and the storage device comprises a second cam follower surface operably driven by the second cam surface to place the storage device in an opened position.

18. The storage device of claim 12 further comprising a sensor module detecting the position of one of the storage device and latch.

19. The storage device of claim 12, wherein the unlock-all mechanism comprises:

a second actuator operably connected to the first link;

wherein each unlocking cam includes an extension arm contacting the respective second link, the extension arm being spaced apart from the first rotational member about which the unlocking cam is pivotably attached to the frame and spaced apart from the second rotational member about which the unlocking cam is pivotably attached to the first link.

20. The storage device of claim 19, wherein the unlock-all mechanism further comprises a manually operated lock set.

* * * * *